US005651702A

United States Patent [19]

Hanning et al.

[11] Patent Number: 5,651,702

[45] Date of Patent: Jul. 29, 1997

[54] TERMINAL BLOCK ASSEMBLY WITH TERMINAL BRIDGING MEMBER

[75] Inventors: Walter Hanning, Detmold; Michael Schnatwinkel, Herford; Manfred Wilmes, Detmold, all of Germany

[73] Assignee: Weidmüller Interface GmbH & Co., Detmold, Germany

[21] Appl. No.: 550,115

[22] Filed: Oct. 30, 1995

[30] Foreign Application Priority Data

Oct. 31, 1994 [DE] Germany ..... 44 38 802.0

[51] Int. Cl.[6] ..... H01R 9/22

[52] U.S. Cl. ..... 439/715

[58] Field of Search ..... 439/709, 715, 439/716, 717

[56] References Cited

U.S. PATENT DOCUMENTS 4,989,118 1/1991 Sorenson ..... 439/715
5,249,979 10/1993 Deinhardt et al. ..... 439/716

FOREIGN PATENT DOCUMENTS 222030 5/1987 European Pat. Off. .
359678 1/1994 European Pat. Off. .
3048497 7/1982 Germany .
4322535 1/1995 Germany .

*Primary Examiner*—Neil Abrams
*Assistant Examiner*—Yong Kim
*Attorney, Agent, or Firm*—Laubscher & Laubscher

[57] ABSTRACT

A terminal block assembly with lateral distribution of electrical power includes a plurality of terminal blocks each containing a plurality of interconnected distributor bars. At least one of the distributor bars of a first conductor is directly connected with a main internal bus bar conductor, and one or more of the remaining distributor bars are connected to the main conductor via a bridge member. Each distributor bar includes a terminal having a contact portion and a bus bar laterally spaced from the contact portion, thereby to define a plug-receiving slot therebetween which opens downwardly and receives either the main conductor or a plug-in link portion of the bridge. The contact portion of the terminal bus bars extends laterally in the direction of adjacent terminal blocks for connection with distributor bars contained within the adjacent terminal blocks, thereby providing lateral distribution of the electrical supply.

9 Claims, 3 Drawing Sheets

TERMINAL BLOCK ASSEMBLY WITH TERMINAL BRIDGING MEMBER

BACKGROUND OF THE INVENTION

1. Field of the Invention

The present invention relates to a terminal block assembly including a plurality of stacked terminal blocks at least one having a plurality of terminals that are laterally connected with corresponding terminals on the adjacent terminal block, and bridge means for selectively connecting the terminal of the one terminal block.

2. Brief Description of the Prior Art

Various devices are known in the prior art for bridging elements which allow for the connection of terminals inside a terminal block assembly and which are suitable for conducting potentials between distributor bars in the direction of the terminal block assembly. Such devices are used, for example, in connecting electrical components such as voltage sources, signal receivers, sensors, actuators, and field units and are also frequently used in control systems with a modular structure. Example of such devices are shown in, for example, German patents Nos. DE 43 22 535 A1, DE 30 48 497 A1, and DE 68 91 20 40 T2. In these prior devices, the lateral or cross-distribution is accomplished using one distributor bar and, as a result, the conducting of the potential does not leave the distributor bar. Consequently, only connection elements are connected to each other in the direction of the terminal block assembly. This results in a failure of the neighboring distributor bars to be reliably brought to the same potential.

The present invention was developed to overcome these and other drawbacks of the prior devices by providing an improved terminal block assembly in which distributor bars are bridged together and include plug-in link portions which provide lateral or cross-distribution of electrical output to adjacent distributor bars contained in adjacent terminal blocks. Such a branching arrangement is especially useful in large complex modular control systems because it allows such systems to be branched and wired in a space saving and flexible manner.

A conductor connected with one of these distributor bars is connected with and supplies power to a control signal device, a printed circuit board, or to an electronics module that is associated with the distributor bar and which belongs to a modular control system.

SUMMARY OF THE INVENTION

Accordingly, a primary object of the present invention is to provide an improved terminal block assembly which affords lateral or cross-distribution of an electrical supply. The terminal block assembly includes conducting means arranged within each terminal block, a plurality of adjacent terminal blocks, a plurality of distributor bars arranged within each terminal block with at least one of the distributor bars being connected to the conducting means, and at least one additional distributor bar, also contained within the terminal block, which is electrically connected with the first distributor bar by a bridge.

It is a further object of the invention to provide distributor bars contained within a terminal block which include a terminal having a contact portion and a laterally spaced bus bar which define a plug-receiving slot therebetween. The plug-receiving slot is open towards the bottom of the terminal block and is adapted to receive either the conductor or a plug portion of the bridge.

It is another object of the invention to provide a distributor bar having a bus bar which includes a plug-in link portion which extends laterally in the direction of an adjacent terminal block and engages the plug-receiving slot of an adjacent distributor bar and, thereby acts to laterally connect or distribute electrical output between adjacent terminal blocks.

It is a further object of the present invention to provide a bridge for electrically connecting two adjacent distributor bars within a terminal block. Each bridge includes a rail portion, a plug-in link portion which engages the plug-receiving slot of the distributor bar, a clip portion which engages a thrust bearing support surface of the terminal block, and laterally spaced leg or spring portions which define a slit adapted to engage the conductor.

It is yet another object of the present invention to provide a terminal block assembly including a bridge having multiple plug-in link portions.

It is a further object of the present invention to provide a terminal block having at least two longitudinally extending parallel support ribs adapted to receive the bridge therebetween.

It is another object of the present invention to provide a terminal block which includes a seat adapted to receive the distributor bars.

BRIEF DESCRIPTION OF THE DRAWINGS

Other objects and advantages of the invention will become apparent from a study of the following specification when viewed in light of the accompanying drawings, in which.

DETAILED DESCRIPTION

Figure 1:
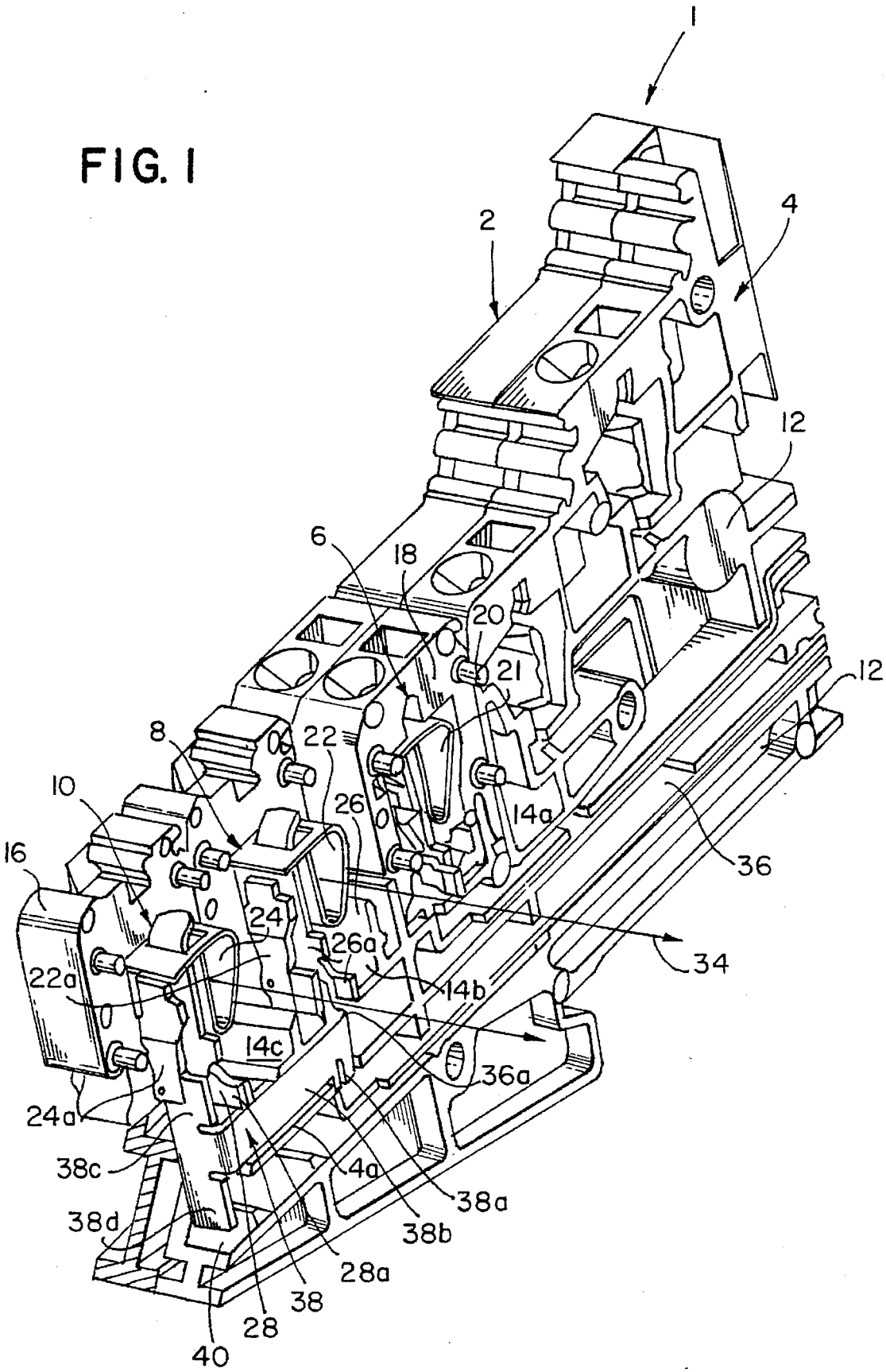
FIG. 1 is a perspective view of the terminal block assembly according to the invention.

Referring first to FIG. 1, there is shown a detailed portion of a terminal block assembly 1 including a pair of terminal blocks 2, 4, although any number of such similarly arranged terminal blocks may be provided. Terminal block 2, which at the end of the terminal block assembly is arranged in front of terminal block 4, can be a PE block that feeds into the terminal block assembly the neutral conductor potential via one of three distributor bars 6, 8, 10. Terminal block 4 is the power supply input terminal block of the terminal block assembly with respect to the potential supply, the potential cross-distribution, and potential branching.

Each terminal block includes a housing 12 having seats 14*a*, 14*b*, 14*c* formed therein which are adapted to receive the aligned generally parallel modular distributor bars 6, 8, 10, respectively.

A label carrier block 16 having no electrical function is provided on terminal block 2. A distributor bar housing 18 is arranged on the input terminal block 4 and acts to enclose the top and sides of the distributor bar 6 in the direction of the terminal block. Each distributor bar housing 18 is provided with a plurality of catch pins 20 on one side and corresponding catch pin receiving recesses (not shown) on the opposite side. These catch pins and recesses act to align the distributor bars during the lineup and makeup of the terminal block assembly and allow the distributor bars to be built up with the desired number of poles.

Figure 2:
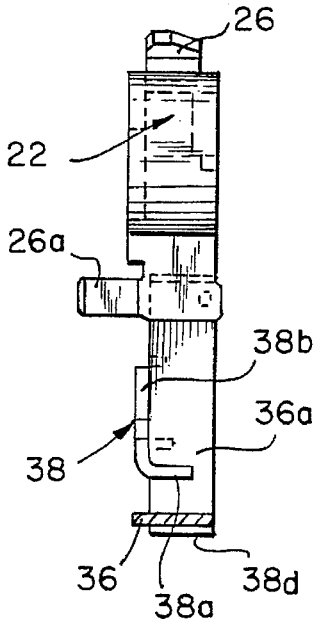
FIG. 2 is an end view of a distributor bar including a terminal and bus bar connected with a conductor and a bridge.
Figure 3:
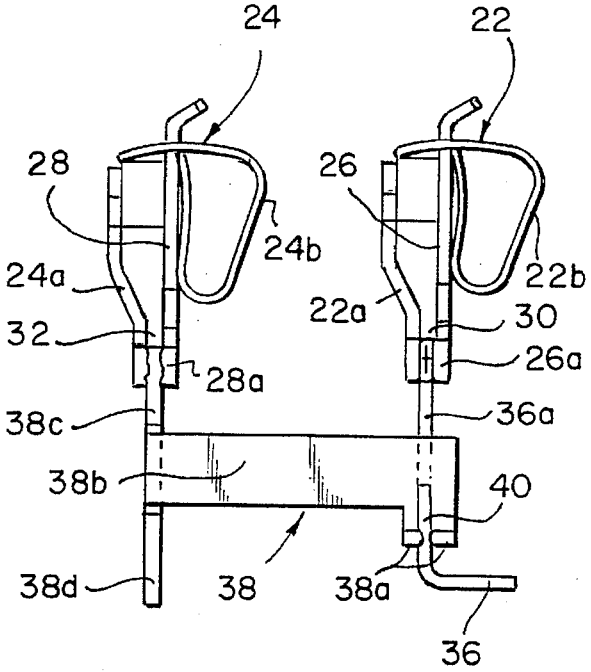
FIG. 3 is a side view of two distributor bars each including a terminal and a bus bar which are connected by a bridge and a conductor.
Figure 4:
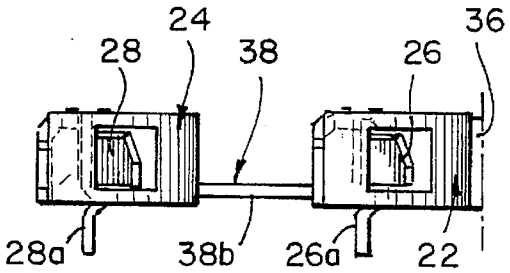
FIG. 4 is a top view of two distributor bars each including a terminal and a bus bar which are connected by a bridge and a conductor.

The distributor bars 6, 8, and 10 contain resilient electrical terminals 21, 22, and 24, respectively. As shown in FIGS. 2–4, the terminals 22 and 24 have stationary base portions 22*a* and 24*a*, and resilient movable resilient portions 22*b* and 24*b*, respectively. The terminals further include bus bar pieces 26, 28 which extend generally parallel to and spaced from the contact portion 22*a*, 24*a* of the terminal and thereby define plug-receiving gaps or slots 30, 32 (FIG. 3) therebetween, respectively, which open toward the bottom of the terminal block. Laterally extending plug-in link portions 26*a*, 28*a* are provided on the respective bus bars 26, 28 and extend in the corresponding slots 30 and 32 contained therein, thereby to carry the potential to the distributor bars contained in the neighboring terminal block located in the direction indicated by the arrows 34. The arrows illustrate the fact that in two neighboring distributor bars, the potential is cross distributed over the plug-in links 26*a*, 28*a* which are inserted into the plug-receiving slots 30, 32.

Alternatively, the distributor bar may have other configurations which can be connected in a potential transferring manner with bridge means as long as they are provided with a free bottom side plug contact element.

The plug-receiving slot 30 of distributor bar 8 receives the upwardly extending end portion 36*a* of a main bus bar conductor 36 mounted within the terminal block 4. The right hand end of conductor 36 extends from the distributor bar 8 through the terminal block housing 12 to a component (not shown), such as a printed circuit board, control lamps or signal devices mounted on the terminal block. In accordance with the present invention, the distributor bar 10 is electrically connected with distributor bar 8 via bridge member 38, as described below.

Out of the first input side terminals 22, 24 in the two distributor bars, one need only plug-in link portions 26*a*, 28*a* when making the line-up for cross-distribution while their corresponding contact portions 22*a*, 24*a* are free and can therefore be used for the bridging potential branch from one distributor bar 8 to another 10 and to a potential branch in addition to the cross-distribution.

As best shown in FIG. 3, the bridge member 38 includes resilient leg portions 38*a* which define a slot 40 which receives and engages the conductor end portion 36*a*. The bridge further includes a rail portion 38*b* which extends between the distributor bars 8, 10 and bends orthogonally inwardly at the end remote from the leg portions 38*a*. At this end, a plug-in link portion 38*c* extends upwardly from the rail portion 38*b* into the downwardly opening slot 32 of distributor bar 10, thereby transferring current from distributor bar 8 to distributor bar 10 via the conductor 36 and bridge member 38. The bridge member also includes a clip portion 38*d* which extends inwardly and downwardly opposite from the plug-in link portion, thereby to support the bridge member in the terminal block.

The conductor end portion 36*a* and the plug-in link portion 38*c* project upwardly into the seats 14 so that the desired contact can be achieved when the distributor bars are inserted. Furthermore, since the plug-receiving slot 32 of distributor bar 10 is free, it can be engaged by the bridge member from the bottom side by the plug-in link portion 38*c* of the bridge member. Thus, a potential or current supplied through an electrical conductor such as a wire (not shown) which is plugged into a first terminal 22 will, via the conductor 36 and bridge member 38, be conducted to the adjacent terminal 24. The current is further conducted laterally through the plug-in link portions 26*a*, 28*a* of the bus bars which engage the contact portion of a terminal contained in neighboring terminal blocks.

Figure 5:
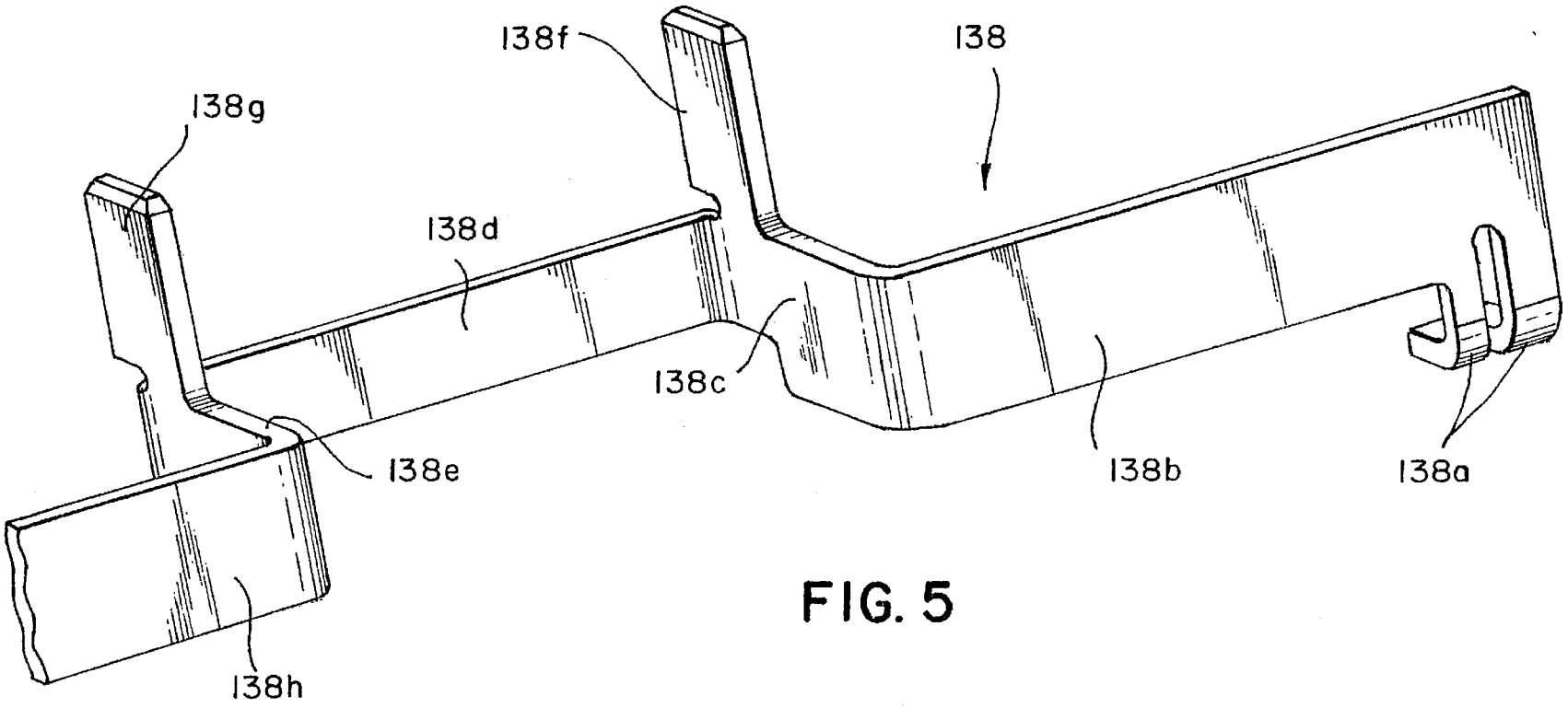
FIG. 5 is a perspective view of a bridge having multiple plug-in link portions.

An alternate bridge member provided with a plurality of plug-in link portions is shown in FIG. 5. This is accomplished with a bridge member having an elongated rail portion which includes a first section 138*b*, a second section 138*c* extending inwardly and orthogonally from the first section, a third section 138*d* extending parallel with the first section, and a fourth section 138*d* extending outwardly from said third section and parallel said second section. A pair of plug-in link portions 138*f* and 138*g* extend upwardly from the second and fourth sections, respectively, of the rail portion and are adapted to be received in the plug-receiving slots contained in the distributor bars.

Each terminal block includes at least two longitudinally extending parallel support ribs 4*a* adapted to receive the bridge therebetween. In this way the bridge is firmly held in place and is fixed in the terminal block. Each terminal block also includes a thrust bearing surface 4*c* which engages the lower end of a clip portion 38*d* of the bridge member and thereby provides added support for the bridge.

While in accordance with the provisions of the Patent Statutes the preferred forms and embodiments of the invention have been illustrated and described, it will be apparent to those of ordinary skill in the art that various changes and modifications may be made without deviating from the inventive concept set forth above.

What is claimed is:

1. A terminal block assembly (1), comprising:

(a) a plurality of parallel adjacent terminal blocks (2,4) at least one of which (4) contains a main bus bar conductor (36);

(b) a plurality of distributor bar means (6,8,10) removably mounted on said terminal blocks, respectively, each of said distributor bars including electrical terminal means (21,22,24), each of said terminal means including:

(1) a contact having stationary (22*a*,24*a*) and movable resilient (22*b*,24*b*) portions;

(2) a stationary bus bar (26,28) arranged in adjacent spaced relation to said contact stationary portion, thereby to define a plug-receiving gap (30,32), said stationary bus bar including a lateral projection (26*a*, 28*a*) adapted for insertion within the corresponding plug-receiving gap of the associated terminal of the adjacent terminal block; and (3) said main bus bar conductor including a connecting portion (36*a*) that is inserted in the plug-receiving gap (30) of a first one (22) of said distributor bar terminals; and (c) conductive bridge means (38) for electrically connecting a second one of said distributor bar terminal means (24) with said main bus bar conductor connecting portion, said bridge means including a first contact portion (38*c*) that extends within the gap (32) of the second terminal means.

2. Apparatus as defined in claim 1, wherein said bridge means includes a bridge member having a support portion (38*d*) that extends oppositely from said first portion, said support portion cooperating with the associated terminal block to support said bridge member thereon.

3. Apparatus as defined in claim 1, wherein said main bus bar (36) includes an orthogonally bent end portion (36*a*) that extends within said first terminal gap (30); and further wherein said bridge member includes a rail portion (38*b*) having first and second ends, said bridge member first contact portion (38*c*) being carried by said first end, said bridge member second end including resilient finger means (38*a*) electrically connected with said main bus bar end portion.

4. Apparatus as defined in claim 3, wherein said bridge member (138) includes extended rail portions (138*d*,138*b*) carrying plug contacts (138*f*,138*g*) adapted to extend within the gaps contained within the terminals of the associated distributor blocks, respectively.

5. Apparatus as defined in claim 1, wherein said gaps (30,32) are contained in the bottom portions of the terminal means and open downwardly, said stationary bus bar lateral projections (26*a*,28*a*) extending laterally outwardly relative to said gaps, respectively.

6. Apparatus as defined in claim 1, wherein said terminal blocks contain a plurality of seats (14*a*,14*b*,14*c*) for receiving said distributor bars (21,22,24), respectively.

7. Apparatus as defined in claim 5, wherein said one terminal block comprises the power supply terminal block of the assembly.

8. Apparatus as defined in claim 2, wherein said terminal block includes a thrust bearing support portion (4*c*) for supporting said bridge support portion (38*d*).

9. Apparatus as defined in claim 8, wherein said terminal block includes a pair of support ribs (14*c*,4*a*) between which said bridge member rail portion is supported.

* * * * *